US007777366B2

(12) United States Patent
Davis

(10) Patent No.: US 7,777,366 B2
(45) Date of Patent: Aug. 17, 2010

(54) ENERGY SAVING SYSTEM FOR USE WITH SWIMMING POOL FILTER SYSTEMS

(75) Inventor: Shawn Davis, Yucca Valley, CA (US)

(73) Assignee: Attune Rtd, Palm Springs, CA (US)

( * ) Notice: Subject to any disclaimer, the term of this patent is extended or adjusted under 35 U.S.C. 154(b) by 921 days.

(21) Appl. No.: 11/608,467

(22) Filed: Dec. 8, 2006

(65) Prior Publication Data

US 2008/0135465 A1 Jun. 12, 2008

(51) Int. Cl.
*H02J 3/14* (2006.01)
*G05D 16/00* (2006.01)

(52) U.S. Cl. ..... 307/38; 700/295

(58) Field of Classification Search ..... 307/38, 307/39; 210/153, 167.01, 167.1, 167.12; 236/49.3; 700/295
See application file for complete search history.

(56) References Cited

U.S. PATENT DOCUMENTS 2,557,375 A 9/1951 Dickenson
3,278,031 A 10/1966 Rosaen
4,419,589 A * 12/1983 Ross ..... 307/39
4,423,335 A 12/1983 Gurr
4,929,363 A 5/1990 Barzuza
4,998,024 A 3/1991 Kirk et al.
5,625,236 A 4/1997 Lefebvre et al.
5,644,173 A 7/1997 Elliason et al.
5,696,695 A 12/1997 Ehlers et al.
5,911,745 A * 6/1999 Conner ..... 62/91
6,109,050 A 8/2000 Zakryk
6,407,469 B1 * 6/2002 Cline et al. ..... 307/11
7,440,864 B2 * 10/2008 Otto ..... 702/119
2005/0121373 A1 6/2005 Thoms
2005/0167345 A1 8/2005 De Wet et al.
2006/0052906 A1 3/2006 Kates
2006/0095164 A1 5/2006 Donnelly et al.

* cited by examiner

*Primary Examiner*—Albert W Paladini
(74) *Attorney, Agent, or Firm*—Greenberg Traurig, LLP

(57) ABSTRACT

A load control system and apparatus to control the load to different elements is disclosed. The load control system is attached to both an air conditioner and a pool filter system. The pool filter system has a predetermined run time and is only operating when the air conditioner is not. When the air conditioner turns on, the load to the pool filter system is disconnected. When the air conditioner turns off, the load is returned to the pool filter which resumes running at the point in the run time where the pool filter had previously left off. The load control system provides a more efficient and better use of energy resources.

14 Claims, 4 Drawing Sheets

ENERGY SAVING SYSTEM FOR USE WITH SWIMMING POOL FILTER SYSTEMS

BACKGROUND

1. Field

Figure 1A:
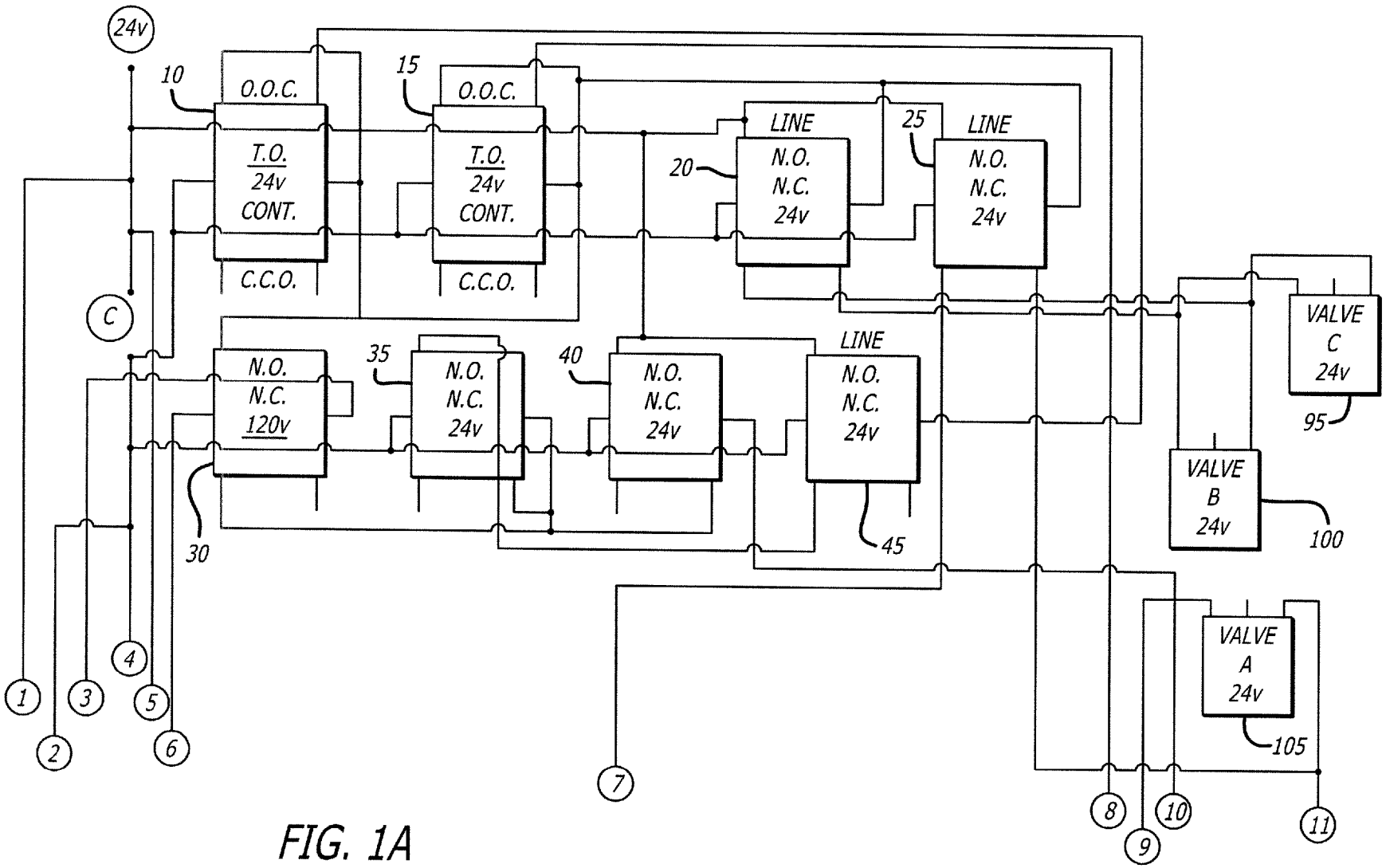

A load control system and method for controlling electrical loads is disclosed. In particular, a load control system and method incorporating a swimming pool filter and circulation system with an air conditioning system to provide the best utilization of energy is disclosed.

2. General Background

Electric utilities are required to have power generating capacity to supply a peak load on a power generating system. Peak loads can vary due to timing of the day and other seasonal characteristics. Additionally, there is an ever increasing demand for electrical energy, particularly during periods of extreme heat when consumers require high amounts of energy for cooling their houses and businesses.

During periods of high energy utilization, there is a need to transfer energy use to certain times of the day to best utilize energy resources. The best utilization of energy requires the controlled use of different appliances. There are several appliances that require a high electrical load to run. However, not all of these appliances are necessary at all times of the day, and can be run during time periods when the electrical needs of a community are smaller.

For example, pool filters require a high electrical load but do not need to run at certain times of the day. However, air conditioners are utilized at times when of high heat, usually during the middle of the day.

Thus, there is a need to provide a system to monitor the load on different elements, and control the loads on different elements to provide the most efficient utilization of energy.

SUMMARY

A load control system and apparatus for controlling the electrical loads to a plurality of load bearing members is disclosed. In an exemplary embodiment, the load control system comprises a first element having a first electrical load and a second element having a second electrical load, the first element acting as a control for the utilization of the second element.

In another embodiment, the load control system includes a load sensor for sensing the first electrical load to the first element. The load sensor is attached to a load control switch. The load control switch controls the load to the second element, only allowing the second element to be actuated when the first element is not running.

In another exemplary embodiment, the second element operates at a timed cycle of a predetermined run time until the first element is operating and carrying the first electrical load, wherein the second element pauses during the timed cycle, the load control switch disconnecting the second electrical load, the load control switch reconnecting the second electrical load and the second element operating at the point in the timed cycle where the second element previously paused once the first element is no longer carrying the first electrical load.

In exemplary embodiments, the second element is a pool filter system running on a timed cycle of a predetermined run time. The pool filter system comprises a pump, a first valve, a second valve at the end of a normal line, water from the second line exiting into a pool, the second valve open during normal operation, a third valve closed during normal operation, a filter and an inline pressure sensor monitoring pressure in the pool filter system.

In another embodiment, wherein once the pressure exceeds a set limit, the first valve is cracked to relieve pressure allowing water to a return line.

In some embodiments, the second element has a predetermined run time wherein the timed cycle of the second element runs about 8 hours in a 24 hour time period.

In another embodiment, the pool filter utilizes diatomaceous earth to filter the water. In other embodiments, the pool filter may utilize sand or cartridges.

In particular embodiments, the first element is an air conditioner.

In further embodiments, the pool filter runs a backwash cycle at the end of the timed cycle if the set limit is exceeded wherein the second valve closes, the third valve opens to run the backwash cycle, the third valve opening into waste. In particular embodiments, the backwash cycle runs about 30 seconds.

In other embodiments, an indicator light is lit when the set pressure limit is exceeded, the indicator light being reset only when the pool filter is serviced. In exemplary embodiment, the set pressure limit is about 20 to 30 pounds per square inch.

In some embodiments, the sensor of the load control system is a transformer.

In further embodiments, a manual override to allow the pool filter to run a backwash cycle and perform maintenance on the pool filter.

Other objects, features, and advantages of the present disclosure will become apparent from the subsequent description and the appended claims.

DRAWINGS

Figure 1B:
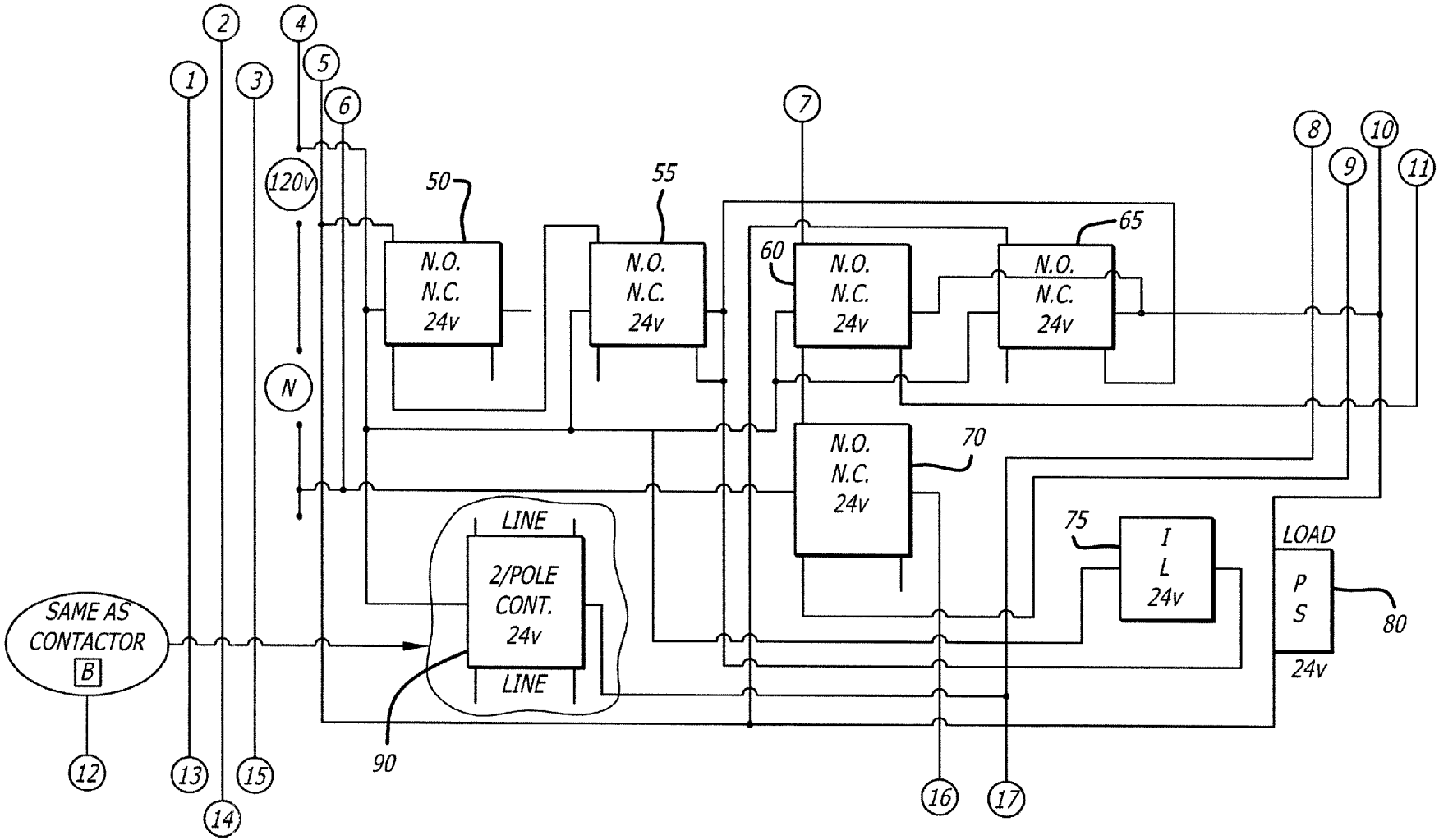
Figure 1C:
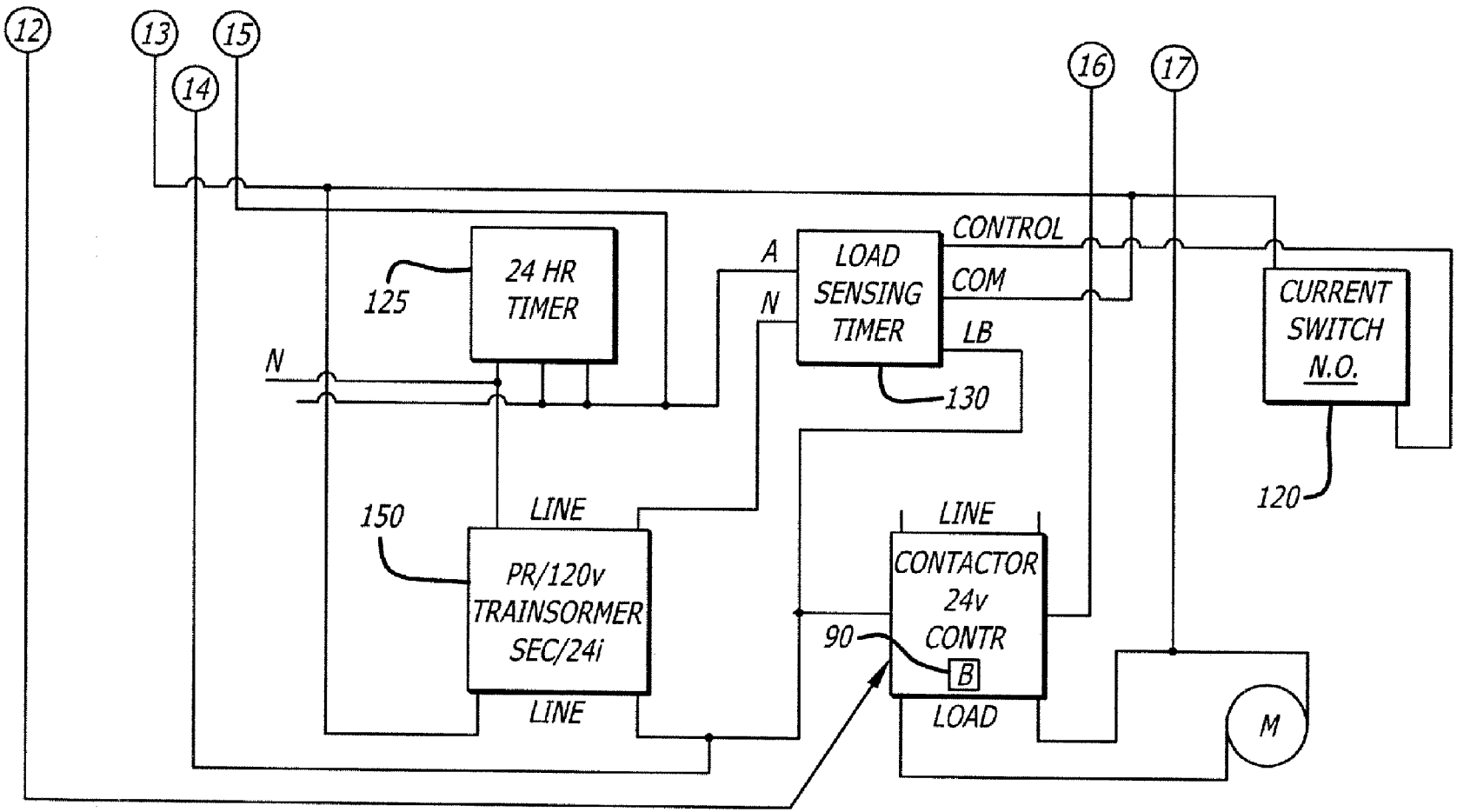

The foregoing aspects and advantages of present disclosure will become more readily apparent and understood with reference to the following detailed description, when taken in conjunction with the accompanying drawings, wherein:

FIG. 1*a*-1*c* illustrates an exemplary schematic of an electrical drawing of one embodiment of the disclosed control system.

Figure 2:
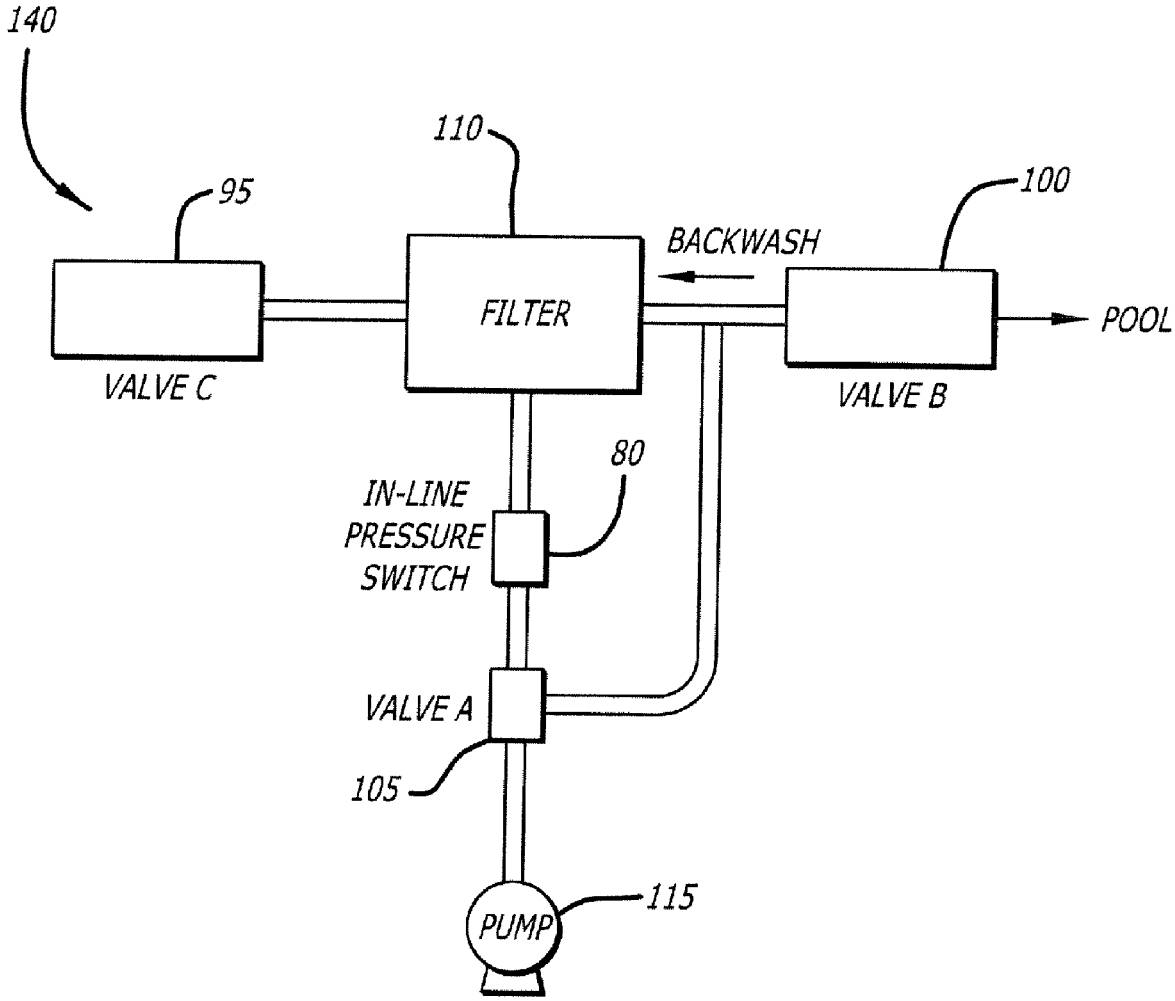

FIG. 2 illustrates a exemplary embodiment of a pool filter system for use with the disclosed control system.

DETAILED DESCRIPTION

A load control system for controlling the electrical loads to a plurality of load bearing members is disclosed. The load control system has a first element having a first electrical load and a second element having a second electrical load. When the first element is on, requiring an electrical load, the second element is not allowed to operate.

In exemplary embodiments, the first element controlled by the system is the air conditioning system. Other appliances utilizing high loads during the day may also be considered to control the system. For example, other appliances that may be utilized including washers/dryers, ovens and others.

In exemplary embodiments, the second element is a pool filter system. In an exemplary embodiment, the pool filter system 140 is controlled and run only when the air conditioning system is not running.

To accomplish this, the second element is connected to a control switch, the control switch being connected to a sensor indicating whether the load to the first element is running. When the first element requires a load, a control switch disconnects the load from the second element, not allowing the second element to run. When the first element is no longer running, the control switch switches the load back to the second element.

In exemplary embodiments, the system provides a way to control the amount of electricity being utilized during various portions of the day. By turning off the second element when the first element is running, there is better energy utilization. In particular embodiments, when the first element is an air conditioner, the first element will run more during the day. Since the second element does not need to necessarily run during this time, this system will run the second element at night. Thus, less load is required for the location during the peak hours of the day.

FIGS. 1*a*, 1*b* and 1*c* illustrate the electrical components for an exemplary embodiment of the load control system. Both of the two elements, the pool filter and the air conditioner, are attached to a transformer 150. For example, a 120 volt (primary) transformer 150 may be connected to deliver each load. When a load is actuated to the pool filter system 140, the secondary of the transformer may provide a low voltage, such as a 24 volt, signal to the appropriate signal circuitry. The air conditioner is run at the higher voltage.

The low voltage signal is sent to a contactor 90 to control the load to the second element, the pool filter system 140. Once this contactor 90 is actuated, a load is sent to the pool filter system 140 to run.

The pool filter system 140 is run on a 24 hour timer 125. The 24 hour timer 125 is connected to a load sensing timer 130. A load sensing timer 130 monitors the time that the load is being sent to the pool filter system 140. Once the predetermined run time for the pool filter system 140 is finished, the load to the pool filter system is Connected to the load sensing timer 130 is a current switch 120. The current switch 120 disconnects the load to the pool filter system 140 when the air conditioner is running.

To run the system, a series of relays 20, 25, 30, 35, 40, 45 are connected to the components of the system. In particular embodiments, the relays 20, 25, 30, 35, 40, 45 are both double pole, normally open, normally closed relays. Each relay has two pairs of electrical poles or contacts, one which is normally closed, the other being normally open. Upon the activation or actuation of the relays, the normally closed relay contacts open, thus opening the associated line circuits, and shedding the electrical loads (appliances or elements) connected to the circuits.

In other embodiments, the load control system may comprise a different electrical system. For example, the system may be controlled by an electrical circuit board, having the same functions as the electrical components shown in the FIG. 1. Various other circuitry and methods may also be utilized.

The pool filter is generally has a predetermined run for a timed cycle. The filter must run for this predetermined run time every 24 hours. Thus, the system includes a 24 hour timer connected to a load sensing timer. The load sensing timer 130 indicates the amount of time that a load is running to the system.

An exemplary pool filter system 140 is illustrated in FIG. 3. The pool filter system 140 may comprise a pump 115, a first, second, and third valve 95 and a filter 110. The pool filter utilizes a pump 115 to cause water to flow to a filter 110. The filter 110 removes impurities from the pool water. After the water flows through the filter 110, the pool water flows through the second valve 100, the water returns back into the pool.

In exemplary embodiment, the pool filter 110 typically contains diatomaceous earth held in grids of the filter 110. Other types of pool filters may also be used in this system. For examples, both sand and cartridge filters may also be utilized with this system.

The filter grids can be damaged if exposed to excessive pressure. Additional problems can also occur to the filter system 140 under high pressure conditions. For example, the filter housing may also be damaged. If the housing or the filter 110 is damaged, these components are expensive and difficult to replace. Additionally, high pressure causes the pool pump 115 and motor to work much harder. When the pump 115, need to work harder, more energy is needed to run the filter system 140. By controlling the pressure in the system, the pressure is maintained at a lower temperature, and the less energy is utilized. Thus, it is advantageous to reduce the pressure in the system.

As a result, the filter system 140 includes an inline pressure switch 80. The inline pressure switch 80 monitors the pressure in the pool filter system 140. As the pressure increases past a certain point, the maximum set pressure point, a first valve 105 is cracked to relieve some of the pressure in the system. A minimal amount of water is bypassed from the normal line into a return line in the system.

In exemplary embodiments, the pressure in the system should not exceed between about 20 to 30 psi. In one particular embodiment, the first valve 105 is opened once the pressure reaches the maximum set pressure of 20 psi.

By opening the first valve 105 in the system, excessive pressure between the pump 115 and the filter 110 is avoided. Since there is less pressure between the components, less energy is needed to run the system, providing a more efficient and better pool filter system 140. In addition to providing a system that utilizes a more efficient utilization of energy with two components, the disclosed system provides a more efficient pool filter system 140.

Once the first valve 105 is activated in response to increased pressure in the system, an indicator light 75 is activated. The indicator light 75 will remain activated until maintenance is preformed on the pool filter system 140. The system further comprises a reset button to turn the indicator light 75 off once maintenance has been performed on the filter system 140.

The indicator light 75 allows the person in charge of maintenance of the pool filter to know when the system has been subject to overpressure. As a result, the person in charge of maintenance will know that the system has backwashed, indicating that the filter 110 may need service. The pool filter may need some diatomaceous earth added to the system, or may need other changes to the system.

To achieve the desired actions once the pressure exceeds a set point, the pressure sensor 80 activates several relays 50, 55 60, 65. The relays 50, 55, and 65 controlling the indicator light 75 are activated, turning the light on. Additionally, another relay 60 activates the first valve 105, cracking the valve slightly to release the pressure. The pressure sensor 80 also activates a relay on the backwash cycle to indicate a backwash cycle should be run at the end of a timed cycle.

The filter system 140 includes a timer 130 that requires the filter to run at a set time cycle daily for a predetermined run time. This load sensing timer 130 is connected to a 24 hour timer 125 that requires that the pool filter system 140 be run once every 24 hours. In exemplary embodiments, the filter system 140 has a run time of about 8 hours for every 24 hour time period. However, the time can be set to any amount of hours necessary to maintain proper pool filtration and health.

At the end of the predetermined run time for the filter system 140, if the first valve 105 had been opened and the pool filter system 140 has been overpressured, a backwash of the system is initiated. To backwash the system, the first valve 105 is fully opened as the second valve 100 is closed. As the second valve 100 is closed, the third valve 95 is opened. The pump 115 is reactivated, and water is forced through the backwash line. After the backwash is performed, the valves are rotated back to the initial position, with the first valve 105 closed, the second valve 100 open, and the third valve 95 closed.

At the end of the timed cycle, the relays 20, 25, 30, 35, 40, 45 controlling the backwash cycle become activated. These relays activate timers 10, 15 in the electrical circuitry to activate the first valve 105, second valve 100, and third valve 95 and turn the valves into the proper position.

The first timer 10 energizes the relay 20 controlling the valves, switching the valves into proper open/closed position to run the backwash cycle. In exemplary embodiments, this timer 10 runs for about 20 seconds to turn the valves into the proper position. A second timer 15 is then activated. This timer 15 actuates a relay controlling the pump 115, allowing the system to backwash.

The system is not backwashed at the time the pressure is increased, but waits until the entire timed cycle has run it course. This will keep the system running and maintain the filtration of the system, even when the system reaches too high of a pressure. This will maintain the system running in its timed cycle, and reduce the amount of maintenance that needs to be done on the system.

If the system does not reach the maximum set point pressure, there is no need for the system to perform the backwash cycle. Instead the system will continue to run, waiting for the next timed cycle to start again and perform the pool filtration.

In exemplary embodiments, the pool filter system 140 also has an override system. This will allow the user maintaining the pool filter to override the system and backwash the filter system 140 at any time. As a result, the pool filter system 140 is able to be cleaned and serviced without any overpressure occurring in the filter system 140.

In other embodiments, the override system also allows the air conditioner and the pool filter system 140 to be run at the same time. This is also a useful component to the system. The maintenance on the pool filter may need to be run at the same time as the air conditioner.

When the pool filter is backwashed, the pool filter is cleared of dirt and debris, even in between maintenance service. As a result, the pool is much cleaner and healthier utilizing the pool filter system described herein.

While the above description contains many particulars, these should not be considered limitations on the scope of the disclosure, but rather a demonstration of embodiments thereof. The load control system and uses disclosed herein include any combination of the different species or embodiments disclosed. Accordingly, it is not intended that the scope of the disclosure in any way be limited by the above description. The various elements of the claims and claims themselves may be combined any combination, in accordance with the teachings of the present disclosure, which includes the claims.

The invention claimed is:

1. A load control system and apparatus for controlling the electrical loads to a plurality of load bearing members, comprising:

a first element having a first electrical load;

a second element having a second electrical load, the first element acting as a control for the actuation of the second element;

a load sensor for sensing the first electrical load to the first element, the load sensor attached to a load control switch, the load control switch controlling the load to the second element;

the second element operating at a timed cycle having a predetermined run time until the first element is operating and carrying the first electrical load, wherein the second element pauses during the timed cycle, the load control switch disconnecting the second electrical load, the load control switch reconnecting the second electrical load and the second element operating at the point in the timed cycle where the second element previously paused once the first element is no longer carrying the first electrical load.

2. The load control system and apparatus of claim 1 wherein the first element is a pool filter system running on a timed cycle, the pool filter system comprising:

a pump;

a first valve;

a second valve at the end of a normal line, water from the second line exiting into a pool, the second valve open during normal operation;

a third valve closed during normal operation;

a filter; and an inline pressure sensor monitoring pressure in the pool filter system;

wherein once the pressure exceeds a set limit, the first valve is cracked to relieve pressure allowing water to enter a return line.

3. The load control system of claim 1 wherein the predetermined run time timed cycle of the second element runs about 8 hours in a 24 hour time period.

4. The load control system of claim 2 wherein the pool filter utilizes diatomaceous earth to filter the water.

5. The load control system of claim 1 wherein the first element is an air conditioner.

6. The load control system of claim 2 wherein the pool filter runs a backwash cycle at the end of the timed cycle if the set limit is exceeded wherein the second valve closes, the third valve opens to run the backwash cycle, the third valve opening into waste.

7. The load control system of claim 6 wherein the backwash cycle runs about 30 seconds.

8. The load control system of claim 2 wherein an indicator light is lit when the set limit is exceeded, the indicator light being reset only when the pool filter is serviced.

9. The load control system of claim 2 wherein the set pressure is about between 20 to 30 pounds per square inch.

10. The load control system of claim 2 wherein the set limit is about 20 pounds per square inch.

11. The load control system of claim 1 wherein the sensor is a transformer.

12. The load control system of claim 2 further comprising a manual override to allow the pool filter to run a backwash cycle.

13. A load control system and apparatus for controlling the electrical loads to a plurality of load bearing members, comprising:

a first element having a first electrical load, the first element being an air conditioner;

a second element having a second electrical load, the first element acting as a control for the actuation of the second element;

a load sensor for sensing the first electrical load to the first element, the load sensor attached to a load control switch, the load control switch controlling the load to the second element; and the second element being a pool filter system operating at a timed cycle having a predetermined run time until the first element is operating and carrying the first electrical load, wherein the second element pauses during the timed cycle, the load control switch disconnecting the second electrical load, the load control switch reconnecting the second electrical load and the second element operating at the point in the timed cycle where the second element previously paused once the first element is no longer carrying the first electrical load;

wherein the pool filter system includes a pump, a first valve, a second valve at the end of a normal line, water from the second line exiting into a pool, the second valve open during normal operation, a third valve closed during normal operation, a filter, and an inline pressure sensor monitoring pressure in the pool filter system, wherein once the pressure exceeds a set limit, the first valve is cracked to relieve pressure allowing water to enter a return line.

14. The load control system of claim 13 wherein the pool filter runs a backwash cycle at the end of the timed cycle if the set limit is exceeded wherein the second valve closes, the third valve opens to run the backwash cycle, the third valve opening into waste.

* * * * *